US007052101B2

(12) United States Patent
Matsumoto et al.

(10) Patent No.: US 7,052,101 B2
(45) Date of Patent: May 30, 2006

(54) SUPPLY FOR IMAGE RECORDING APPARATUS, METHOD OF DETERMINING THE SAME AND METHOD OF MANUFACTURING THE SAME

(75) Inventors: Nobuo Matsumoto, Kanagawa (JP); Seiichi Inoue, Kanagawa (JP); Takashi Okuyama, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/908,743

(22) Filed: Jul. 20, 2001

(65) Prior Publication Data

US 2002/0036668 A1 Mar. 28, 2002

(30) Foreign Application Priority Data

Jul. 21, 2000 (JP) ..... 2000-220496

(51) Int. Cl.
*B41J 29/393* (2006.01)

(52) U.S. Cl. ..... 347/19; 347/86; 347/214

(58) Field of Classification Search ..... 347/19, 347/2, 214, 85, 86; 355/18
See application file for complete search history.

(56) References Cited

U.S. PATENT DOCUMENTS 5,719,608 A * 2/1998 Sabonis et al. ..... 347/85
6,039,430 A * 3/2000 Helterline et al. ..... 347/19
6,161,916 A * 12/2000 Gibson et al. ..... 347/19
6,362,869 B1 * 3/2002 Silverbrook ..... 355/18

FOREIGN PATENT DOCUMENTS

| | | |
|---|---|---|
| JP | 48-009622 A | 2/1973 |
| JP | 54-051837 | 4/1979 |
| JP | 05-050601 | 3/1993 |
| JP | 11-207956 | 8/1999 |

OTHER PUBLICATIONS

Leon-Garcia et al. (Communication Networks, Fundamental Concepts and Key Architectures).*

* cited by examiner

*Primary Examiner*—Hai Pham
*Assistant Examiner*—Lam S. Nguyen
(74) *Attorney, Agent, or Firm*—Whitham, Curtis, Christofferson & Cook, PC

(57) ABSTRACT

A supply such as an ink tank or the like, which is mounted on an image recording apparatus, includes a recording section in which encoded information created by encoding identification information by a secret key is recorded, and the encoded information is decoded by a decoding key provided with the image recording apparatus and then checked. With this arrangement, it can be advantageously prevented that the supply such as the ink tank or the like is mounted on the image recording apparatus by mistake, whereby the deterioration of image quality, the trouble of the image recording apparatus and the like caused by the supply mounted by mistake can be prevented.

24 Claims, 5 Drawing Sheets

SUPPLY FOR IMAGE RECORDING APPARATUS, METHOD OF DETERMINING THE SAME AND METHOD OF MANUFACTURING THE SAME

BACKGROUND OF THE INVENTION

1. Field of the Invention

The present invention relates to the technical field of an image recording apparatus such as an inkjet printer, a printer of a silver halide photographing system, a printer of a non-silver halide photographing system such as an electrophotographic system, a photographing apparatus and the like, and more particularly, to supply for the image recording apparatus which is capable of allowing the image recording apparatus to stably exhibit the predetermined performance thereof, a method of determining the supply and a method of manufacturing the supply.

2. Description of the Related Art

Japanese Unexamined Patent Application Publications Nos. 48(1973)-9622, 54(1979)-51837 and the like disclose an inkjet printer which is arranged such that ink is heated with pulses and partly vaporized rapidly and an ink droplet is ejected from an orifice by the expansion force of the vaporized ink.

Further, Japanese Unexamined Patent Application Publications Nos. 5(1993)-50601, 11(1999)-207956 and the like disclose an inkjet printer arranged such that a diaphragm (oscillating sheet) is disposed in an ink chamber and oscillated by static electricity, a piezo element or the like so as to eject an ink droplet from a nozzle by the oscillation.

These inkjet printers have been widely used as printers for various applications such as a color printer for personal computers and the like because they are advantageous in that their cost is relatively low and they can easily be handled and provide an image of good quality.

In various types of printers and image recording apparatuses including these inkjet printers, it is important that various types of supplies such as consumable goods that are mounted thereon be appropriate supplies in order for them to sufficiently and stably exhibit a predetermined performance.

For example, in the above-described inkjet printer, if an ink tank containing ink the validity of which has expired (hereinafter referred to simply as "ink tank the validity of which has expired" for convenience) or an ink tank corresponding to a different type of a printer is mounted on the aforementioned inkjet printers, they cannot exhibit the predetermined performances and various disadvantages, for example, the output of an inappropriate image with low image quality, the occurrence of troubles such as the clogging of an ink path, a nozzle and the like are generated.

To cope with these problems, there has been desired to realize a method of appropriately and effectively preventing supplies such as a consumables accommodation body, which does not appropriately correspond to a printer and the like, for example, an ink tank the validity of which has expired from being mounted (by mistake) on a printer and the like.

SUMMARY OF THE INVENTION

An object of the present invention for solving the problems of the above-described conventional art is to provide a supply for an image recording apparatus, a method of determining the supply for an image recording apparatus, and a method of manufacturing the supply for an image recording apparatus, wherein mounting an inappropriate supply or supplies such as inappropriate consumables or an inappropriate consumables accommodation body on the image recording apparatus by mistake or misusing it, for example, mounting an ink tank the validity of which has expired on an inkjet printer and the like, can be preferably prevented so that deterioration of an image quality or troubles caused by such mounting by mistake or misuse can be eliminated to allow the image recording apparatus to stably exhibit a predetermined performance.

In order to attain the object described above, the first aspect of the present invention provides a supply which is mounted on an image recording apparatus, comprising: a recording section in which encoded information created by encoding identification information related with the supply is recorded.

Preferably, the encoded information is created by encoding by means of a public key cryptosystem, that is to say, the encoded information is encoded information which is created by encoding the identification information by means of an encoding key different from a decoding key (hereinafter, referred to as "secret key").

The second aspect of the present invention provides a method of determining a supply which is mounted on an image recording apparatus, comprising the steps of: decoding at least one of encoded identification information of the supply and identification information encoded after it is compressed of the supply by a decoding key which the image recording apparatus or a computer connected thereto has; and determining whether or not the supply is appropriate using the thus decoded information.

Preferably, the encoded identification information is what is encoded by a key (secret key) different from the decoding key and wherein the identification information encoded after it is compressed is what is encoded by the secret key different from the decoding key after it is compressed.

Preferably, when it is determined that the supply is inappropriate, at least one of issuing a warning and switching a state in which the supply is usable to the other state in which the supply is unusable is executed.

The third aspect of the present invention provides a method of manufacturing a supply which is mounted on an image recording apparatus, comprising the step of: recording at least one of encoded information created by encoding identification information of the supply, and compressed encoded information created by encoding the identification information of the supply after it is compressed.

Preferably, the encoded information is what is created by encoding the identification information by a secret key (key different from the decoding key) and wherein the compressed encoded information is what is created by encoding the identification information by the secret key after it is compressed.

Preferably, in the respective aspects of the present invention, the supply is any one of consumable goods, a consumables accommodation case for accommodating the consumable goods and a consumables accommodation body which has accommodated the consumable goods in the consumables accommodation case.

Preferably, the recording section is provided to at least one of the consumable goods in the consumables accommodation body and the consumables accommodation case of the consumables accommodation body.

Preferably, the identification information comprises at least one information selected from the group consisting of: information of a manufacturing date, a lot number, a serial number, a term of validity for use, a term of validity of initial mounting, a content, a manufacturer, a type of a corresponding image recording apparatus, a type of the supply, an accommodation amount of the supply and a size of the supply.

Preferably, the identification information corresponding to the encoded information is recorded in the recording section.

Preferably, the identification information corresponding to the encoded information is recorded as compressed information together with the encoded information.

Preferably, the encoded information is encoded after the identification information is compressed.

Preferably, compressed encoded information that is obtained by encoding the identification information after it is compressed is also recorded, in addition to the encoded information.

Preferably, an operation of the being compressed is executed using a hash function.

DESCRIPTION OF THE PREFERRED EMBODIMENTS

A supply for an image recording apparatus, a method of determining the supply for the image recording apparatus and a method of manufacturing the supply for the image recording apparatus of the present invention will be described in detail below with reference to the preferable embodiments shown in the accompanying drawings.

In the present invention, the supply for the image recording apparatus may be any one selected from the group consisting of: consumable goods to be applied to the image recording apparatus as a matter of course; a consumables accommodation case that is an accommodation case which accommodates the consumable goods; and a consumables accommodation body in which the consumable goods are accommodated in the consumables accommodation case, that is, the consumables accommodation body which is composed of the consumable goods and the consumables accommodation case.

Note that while an embodiment in which the present invention is applied to an inkjet printer and an ink tank used in the inkjet printer as the image recording apparatus and the supplies thereof, respectively will be described below, the present invention is by no means limited to the embodiment and can be applied to various types of image recording apparatuses and supplies thereof. For example, the present invention can advantageously be applied to recording paper for the inkjet printer, an ink cartridge in which an ink tank is integrated with an inkjet head, for the inkjet printer. Further, the present invention can also be advantageously applied to various types of printers as various types of supplies for an image recording apparatus such as consumable goods and consumable accommodation bodies including, for example, a toner cartridge for an electrophotographic printer using, an ink ribbon cartridge for a dot impact printer or a thermal transfer printer. Furthermore, the present invention can advantageously be applied to various types of imaging apparatuses such as a photographing apparatus and a photoprinter thereof for a print output and the like as various types of supplies for an image recording apparatus such as consumable goods and consumables accommodation bodies such as a light-sensitive material for a silver halide photographing system, for example, silver halide color paper and the like.

Figures 1A, 1B:
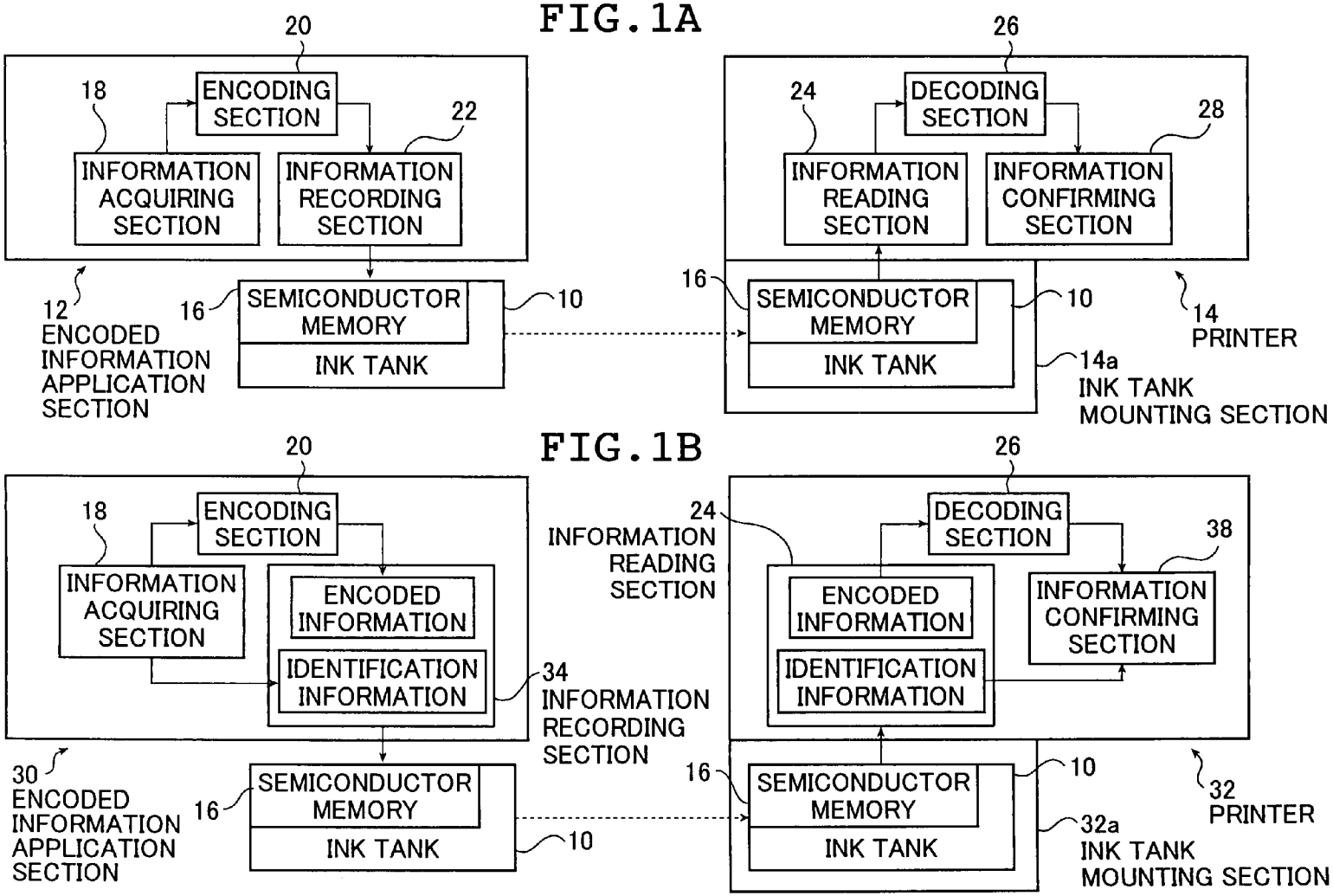
FIGS. 1A and 1B are schematic views, each explaining an embodiment of an ink tank and an inkjet printer making use of the present invention.
Figure 2A:
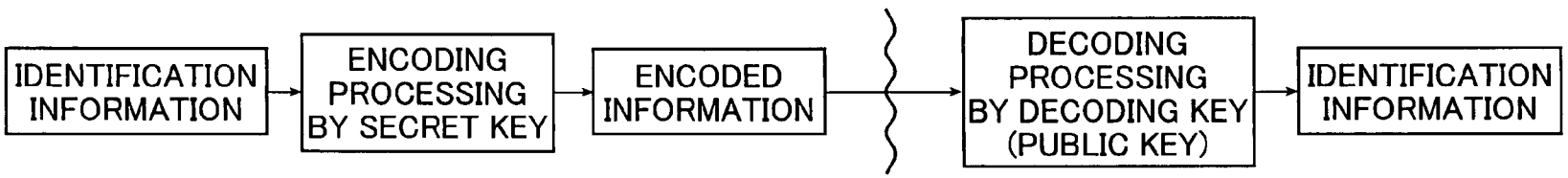
FIGS. 2A and 2B are schematic views, each explaining an example of the flow of operations in the present invention.

FIG. 1A schematically shows an embodiment in which the present invention is applied to an inkjet printer and an ink accommodation body which is a consumables accomodation body, that is, an ink tank, and FIG. 2A shows an example of a flow of operations.

FIG. 1A shows an encoded information application section 12 in an apparatus for manufacturing an ink tank 10 on a left side and an inkjet printer (hereinafter, abbreviated as "printer") 14 on a right side. Further, the ink tank 10 includes a semiconductor memory 16 acting as a recording section for recording encoded information.

In the example shown in FIG. 1A, the encoded information application section 12 encodes the identification information of the ink tank 10 and records the resultant encoded identification information in the semiconductor memory 16. The encoded information application section 12 comprises an information acquiring section 18, an encoding section 20, and an information recording section 22.

The information acquiring section 18 acquires or further creates identification information for identifying the consumables accomodation body (that is, the ink tank 10 as illustrated in FIG. 1A) and sends it to the encoding section 20.

As long as the identification information of the ink tank 10 is information capable of confirming that the ink tank 10 is an ink tank which accommodates ink appropriately corresponds to the printer 14, various types of information related with ink which is a consumable goods and an ink tank 10 which is a consumables accommodation body can be utilized.

As an example thereof, with regard to the ink or the ink tank 10, illustrated are a manufacturing date, a lot number used in manufacturing, a serial number of product, a term of validity for use, information as to a content such as color, a type of ink and the like, a term of validity of first mounting (until the time of first mounting to the printer 14), a manufacturer (and its identification information), information as to a type of a corresponding printer 14, information as to a size, a type and the like of an ink tank, an amount of ink accommodated, and so on. At least one of various types of information may be used as the identification information. Further, the identification information may be a check symbol, such as a character string, a symbol string or the like that is arbitrarily created for confirmation, in addition to the direct information of the ink tank 10. Furthermore, the identification information may include redundant information to make it difficult to decrypt (decipher) cipher and to improve modified information detecting capability.

Further, even in a case in which the encoded information and the like can directly be recorded on the consumable goods itself such as recording paper for the inkjet, silver halide color paper or the like, at least one of various pieces of information such as, with reference to the consumable goods itself, the manufacturing date, the manufacturing lot number, the manufacturing serial number, a term of validity for use, the content, the term of validity of first mounting, the manufacturer, the type of the corresponding printer, the type of the consumable goods, the accommodated amount, the size and other information may be used as the identification information of the consumable goods itself.

The encoding section 20, which has received the identification information of the ink tank 10 from the information acquiring section 18, encodes (encrypts) the identification information using a predetermined secret key as shown in FIG. 2A and sends the identification information to the information recording section 22 as encoded information.

The information recording section 22, which has received the encoded identification information (encoded information) records it in the semiconductor memory 16 disposed on the ink tank 10.

Note that, in the present invention, the recording section for recording the encoded information or further recording identification information to be described later is not limited to the semiconductor memory 16 illustrated in FIGS. 1A and 1B.

Various types of recording mediums, for example, a magnetic recording medium, an optical recording medium, a magneto-optic recording medium, and so on may be utilized for the recording section. Further, the recording section may be arranged as a seal of hard copy recorded on which is encoded bar-code information, a character or symbol string corresponding to encoded information or encoded information itself. Furthermore, the recording section may be arranged as an engraved mark of the character or symbol string corresponding to the encoded information or the encoded information itself. Furthermore, when the encoded information and the like is directly recorded in the consumable goods, for example, such information may be recorded on a rear surface of the recording paper for inkjet or the silver halide color paper as the character string, symbol string or the mark.

Further, even if any type of the recording sections is employed, it is preferable to arrange the recording section such that information, such as encoded information or, further, identification information and the like cannot be copied or rewritten. Further, it is preferable to arrange the printer 14 such that it does not operate or normally or correctly operate in response to the copied information or rewritten information. This arrangement permits the printer 14 to realize its predetermined performance more stably. Note that any known method may be used to prevent encoded information from being copied according to the arrangement of the recording section and a recording method in which it becomes hard for the presence of a cipher itself to be recognized by, for example, recording the cipher as a watermark on a mark or character of a trademark, a model number of the supply such as the consumable goods and the like and, further, it becomes hard for the cipner to be copied by deteriorating a quality of the mark or character when copied. When the cipher which has been recorded as the watermark on the mark such as the trademark and the like, not only the cipher is read, but also other portions of the mark which do not contain the cipher are read to prevent an inappropriate supply such as inappropriate consumable goods from being used in a more accurate manner.

Figure 4A:
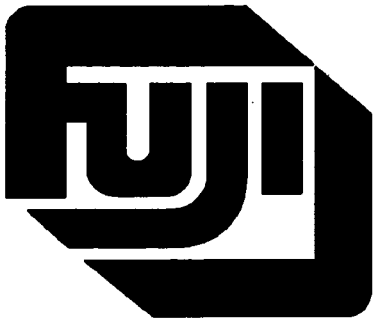
FIGS. 4A to 4F are views, each explaining an example of an application of a watermark to a trade mark.

For instance, examples in which a cipher of identification code is imparted in a trademark (mark) shown in FIG. 4A as a watermark are shown in FIGS. 4B to 4F. Namely, in these cases, the trademark provided to the supply such as the consumable goods or the consumables accommodation body functions as the recording section in which the encoded information according to the present invention is recorded.

FIGS. 4B to 4F are examples in which the 16-bit identification signal (b1 to b16) is imparted in the trademark shown in 4A. On this occasion, one bit is a parity bit for checking the identification signal (identification data bit).

Figure 4B:
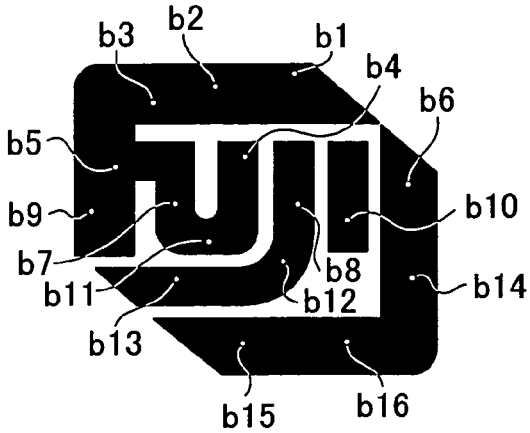
Figure 4C:
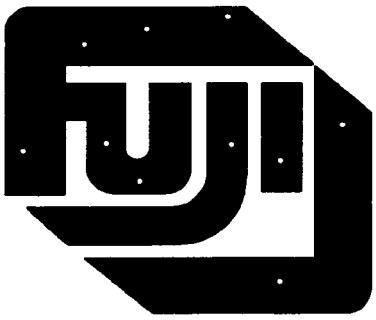
Figure 4D:
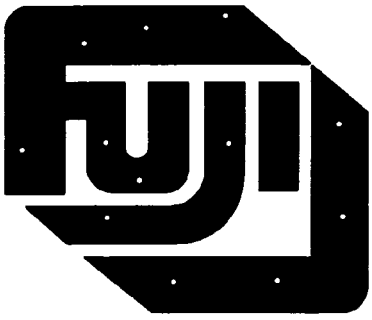
Figure 4E:
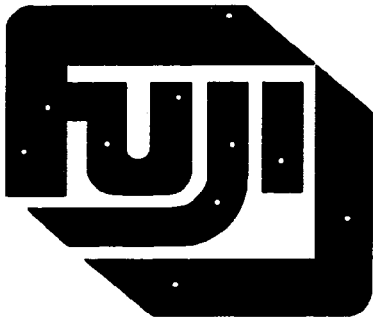
Figure 4F:
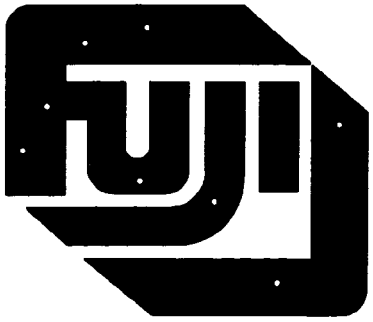

FIG. 4B shows a case in which a point mark are imparted in each of all bit positions of 16 bits as a watermark; the identification data is shown as 0000000000000000, as shown in Table 1. Further, FIGS. 4C, 4D, 4E and 4F each show a case in which point marks are imparted in some bit positions of 16 bits as watermarks.

TABLE 1

| bit | 1 b1 | 2 b2 | 3 b3 | 4 b4 | 5 b5 | 6 b6 | 7 b7 | 8 b8 | 9 b9 | 10 b10 | 11 b11 | 12 b12 | 13 b13 | 14 b14 | 15 b15 | 16 b16 |
|---|---|---|---|---|---|---|---|---|---|---|---|---|---|---|---|---|
| B | 0 | 0 | 0 | 0 | 0 | 0 | 0 | 0 | 0 | 0 | 0 | 0 | 0 | 0 | 0 | 0 |
| C | 0 | 0 | 0 | 1 | 0 | 0 | 0 | 0 | 1 | 0 | 0 | 1 | 1 | 1 | 1 | 0 |
| D | 0 | 0 | 0 | 1 | 1 | 0 | 0 | 0 | 0 | 1 | 0 | 1 | 0 | 0 | 0 | 0 |
| E | 0 | 1 | 1 | 0 | 0 | 1 | 0 | 0 | 0 | 0 | 1 | 0 | 1 | 0 | 0 | 1 |
| F | 1 | 0 | 0 | 1 | 0 | 0 | 1 | 1 | 0 | 1 | 0 | 0 | 1 | 1 | 1 | 0 |

Further, in the present invention, the recording section including the semiconductor memory 16 or the like for recording encoded information is not limited to the one that is integrated with the ink tank (consumables accommodation body) 10. That is, the recording section may be arranged independently of the ink tank 10, or may be arranged so as to be detachably mounted on the ink tank 10.

Namely, in the present invention, as described above, with regard to the consumables accommodation body such as the ink tank 10, it is preferable to provide the recording section on the accommodation case of the consumable goods such as the ink tank body; however, in a case of the consumable goods capable of being directly recorded with encoded information thereon, such as recording paper for the inkjet, silver halide color paper or the like, the recording section can also be provided on a package which comes to be an accommodation case of the consumable goods and the consumable goods themselves.

Therefore, in the present invention, it is preferable that the recording section is provided on at least one of the consumable goods and the accommodation case of the consumables accommodation body.

In contrast, the printer 14 corresponding to the ink tank 10 comprises an information reading section 24, a decoding section 26, and an information confirming section 28.

The printer 14 is basically a known inkjet printer except that it includes these information processing sections.

When the ink tank 10 is mounted on the ink tank mounting section 14*a* of the printer 14, the information reading section 24 reads the encoded information from the semiconductor memory 16 and sends it to the decoding section 26.

The decoding section 26 includes a decoding key (decryption key) corresponding to the secret key used in the encoding section 20 of the encoded information application section 12. The decoding section 26 decodes (decrypts) the encoded information using the decoding key as shown in FIG. 2A and sends the decoded identification information to an information confirming section 28.

It is preferable to employ a public key as the decoding key used in the decoding section 26 because the public key makes it easy to manufacture the printer (image recording apparatus).

The methods of encoding and decoding are not particularly limited and, preferably, an asymmetric cryptosystem, namely, a public key cryptosystem which uses different keys at the times of encoding and decoding and does not allow one key to calculate the other key in an easy manner. As the public key cryptosystem, a known method, for example, ACE sign, RSA-PSS, RSA-OAEP, EPOC-1, EPOC-2, EPOC-3, HIME-1 or HIME-2 based on a difficulty in prime factorization, DSA or ACE Encrypt based on a discrete logarithmic problem, ECAES in SEC1 using an elliptic curve, ECDSA in SEC1, MY-ELLTY ECMR using an elliptic hyperbolic curve, ESIGN-signature based on an approximate function for e-th root or the like can be used.

The information confirming section 28 confirms the identification information sent thereto. When the ink tank 10 being mounted does not appropriately correspond to the printer 14 (that is, it is mounted by mistake) because of the reasons that the validity thereof has expired, it is dedicated for other type of printer, the content thereof is inappropriate and the like, the information confirming section 28 determines that the ink tank 10 is inappropriate and sends the result of determination to a predetermined section of the printer 14, for example, to the controller (not shown) thereof.

When it is determined that the ink tank 10 is appropriate based on the result of determination, the controller of the printer 14 maintains an ordinary state. In contrast, when the ink tank 10 is inappropriate, the controller warns that the ink tank 10 is mounted by mistake through sound, display or the like and, further, optionally switches the printer 14 to a state in which the ink tank (consumables accommodation body) can not be used.

Thus, according to the present invention, an ink tank can be prevented from being mounted by mistake to ensure that the ink tank that is appropriate to the printer 14 can be mounted at all times. As a result, the printer 14 can stably exhibit the predetermined performance thereof by preventing the occurrence of troubles, deterioration of image quality and the like which are caused by mounting the ink tank by mistake.

We now describe the method of determination of the supply and such as the consumable goods and the consumables accommodation body according to the present invention in more detail.

Encoded data was recorded on a trademark (mark) as shown in FIG. 4A as a watermark.

In FIG. 5A, shown is a flow of operations of the method of determination of the supply such as the consumable goods (ink) or the consumables accommodation body (ink tank 10) having as a recording section a mark (trademark), as shown in each of FIGS. 4B to 4F, in which encoded data has been recorded in a trademark (mark) shown in FIG. 4A as a watermark.

This method of determination reads such marks (by the image reading apparatus in the image recording apparatus), decodes the thus read marks and confirms whether or not the supply (consumable goods) of interest is appropriate and usable.

Figure 5:
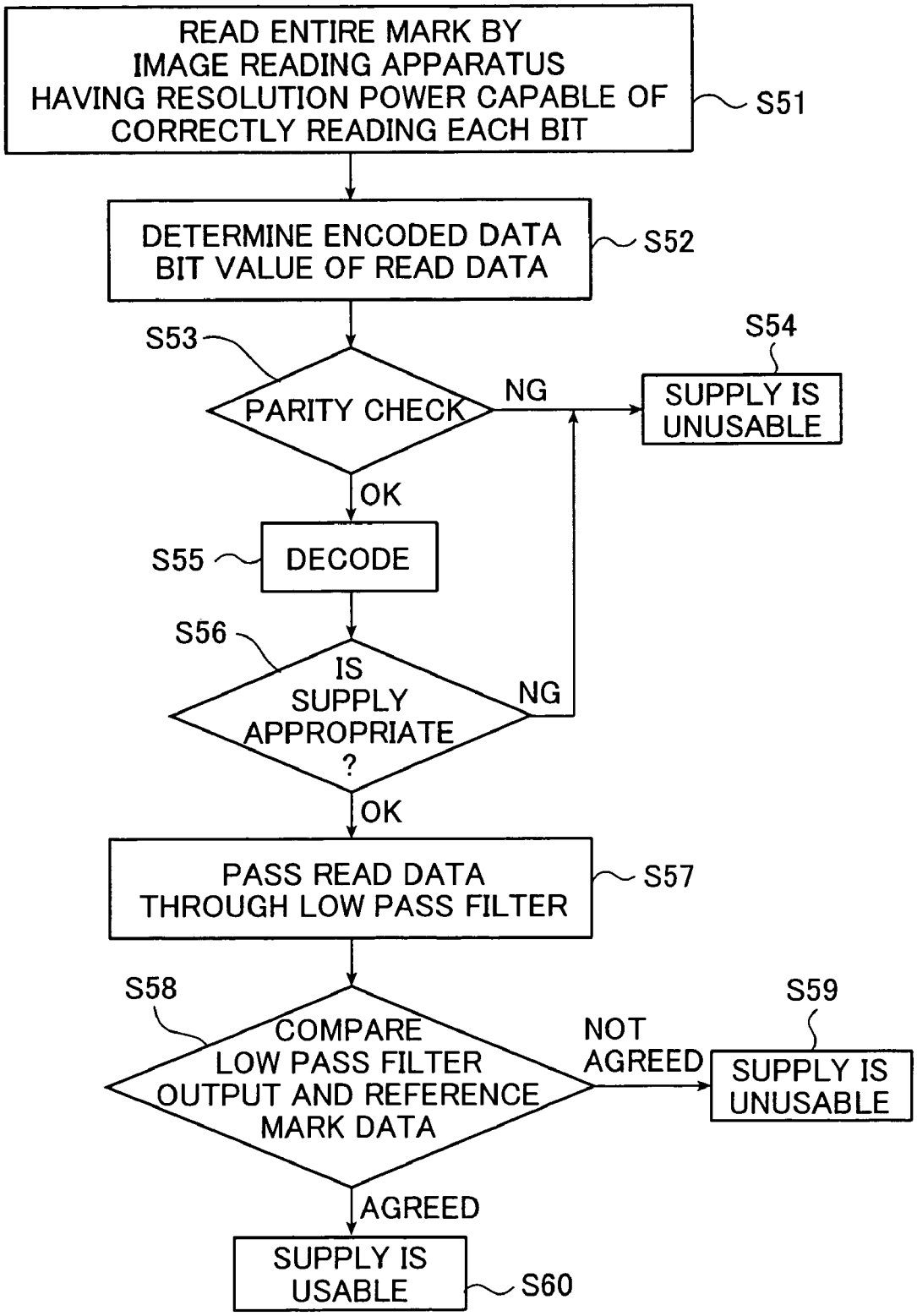
FIG. 5 is a flow chart showing a flow of operations of a method of determining a supply or a supply accommodation body in the present invention.

In step S51 of FIG. 5, for example, an entire mark is read by an image reading apparatus, for example, the information reading section 24 of the printer 14 shown in FIG. 1A, having a resolution power capable of correctly reading each bit of the mark (trademark) shown in 4C which has been imparted to the ink tank 10 of the printer 14 shown in FIG. 1A.

Next, in step S52, encoded data bit value of read data is determined.

Subsequently, in step S53, a parity check is performed for checking a parity bit of identification data bit.

When a result of the parity check is "disparity" (NG), the supply (consumable goods) is determined as unusable by a controller (not shown) of the printer 14 in step S54.

On the other hand, when a result of the parity check is "parity" (OK), decoding is executed by the decoding key, namely, the public key, for example, in the decoding section 26 to produce decoded identification information in step S55.

Next, in the information confirming section 28, the decoded identification information is confirmed and determined whether or not the supply (consumable goods) is appropriate. When a result of determination is "inappropriate supply" (NG), the operation goes back to the above-described step S54 in which the supply (consumable goods) is determined as unusable by the above-described controller. When a result of determination is "appropriate supply" (OK), read data read in step S51 is passed through a low-pass filter in step S57 and, then, an output passed through the low-pass filter is compared with reference mark data in step S58, so as to determine whether or not the read data itself read in step S51 is effective.

When a result of comparison is "not agreed", the supply (consumable goods) is determined as "unusable" by the above-described controller in step S59.

On the other hand, a result of the comparison is "agreed", the supply (consumable goods) is determined as "usable" by the above-described controller in step S60.

Therefore, according to the method of determination of the present invention, mounting the supply such as the consumable goods or the consumables accommodation body by mistake or misuse thereof can be prevented and the image recording apparatus (printer 14) can always mount the appropriate supply such as the consumable goods or the consumables accommodation body thereon, use it and, further, stably exhibit the performance thereof by preventing the occurrence of troubles, deterioration of image quality and the like which are to be caused by mounting the supply such as the consumable goods or the consumables accommodation body by mistake or misuse thereof.

While what is recorded in the semiconductor memory 16 of the ink tank 10 is only encoded information in the example shown in FIG. 1A, the present invention is not limited thereto, and identification information that is not encoded may be recorded in the semiconductor memory 16 (recording section). With this arrangement, whether the ink tank 10 is appropriate or not can be more correctly confirmed.

Figure 2B:
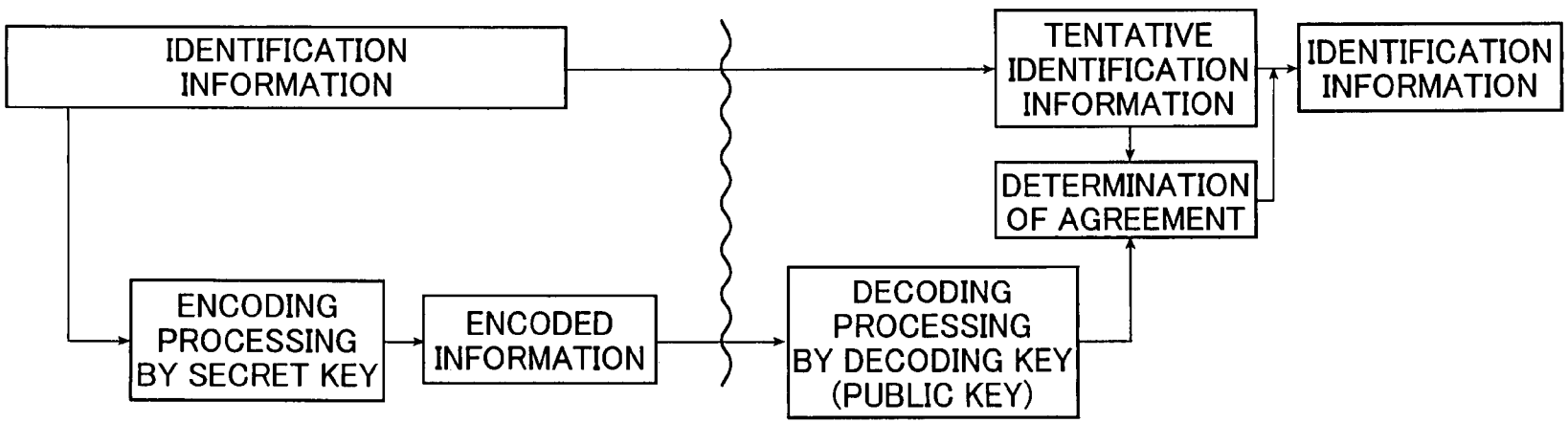

An example of the above system is schematically shown in FIG. 1B, and the flow of the operations of the system is shown in FIG. 2B. Note that the example shown in FIG. 1B has many constituents that are common to those of the example shown in FIG. 1A described above. Thus, the same sections are denoted by the same reference numerals and the following description will mainly be made as to different sections.

In the example shown in FIG. 1B, the encoded information application section 30 of an ink tank manufacturing apparatus includes an information acquiring section 18, an encoding section 20 and an information recording section 34, similarly to the previous example.

Identification information acquired by the information acquiring section 18 is encoded by the encoding section 20 and sent to the information recording section 34, similarly to the previous example. In parallel to the above operation, the identification information is also sent from the information acquiring section 18 to the information recording section 34.

The information recording section 34 records both of the encoded information obtained by encoding the identification information and the identification information in the semiconductor memory 16 of the ink tank 10.

A printer 32 in this mode includes an information reading section 24, a decoding section 26, and an information confirming section 38 similarly to those of the above example.

When the ink tank 10 is mounted on the ink tank mounting section 32*a* of the printer 32, the information reading section 24 reads the encoded information and the identification information recorded in the semiconductor memory 16. Similarly to the above example, the encoded information is decoded (decrypted) in the decoding section 26, decoded to the identification information (hereinafter, referred to as decoded identification information for the sake of convenience) and sent to the information confirming section 38. Further, the read identification information is also sent from the information reading section 24 to the information confirming section 38.

The information confirming section 38 first confirms whether or not the decoded identification information is in agreement with the read identification information (tentative identification information) sent from the information reading section 24. When they are not in agreement with each other, the information confirming section 38 determines that the ink tank 10 is inappropriate because the identification information is inappropriate. In contrast, when they are in agreement with each other, the information confirming section 38 further confirms the identification information itself similarly to the above example and determines whether or not the ink tank 10 is appropriate to the printer 32.

The result of determination is sent to the controller of the printer 32 similarly to the above example, and, when the ink tank 10 is inappropriate, countermeasures are taken by issuing warning, stopping a print operation or the like, similarly to the previous example.

In this mode in which the identification information is also recorded in the semiconductor memory 16 (recording section) of the ink tank 10 in addition to the encoded information, it is preferable that the encoded information be created by encoding the identification information compressed by a hash function. With this operation, the reliability of information can be improved.

Figure 3A:
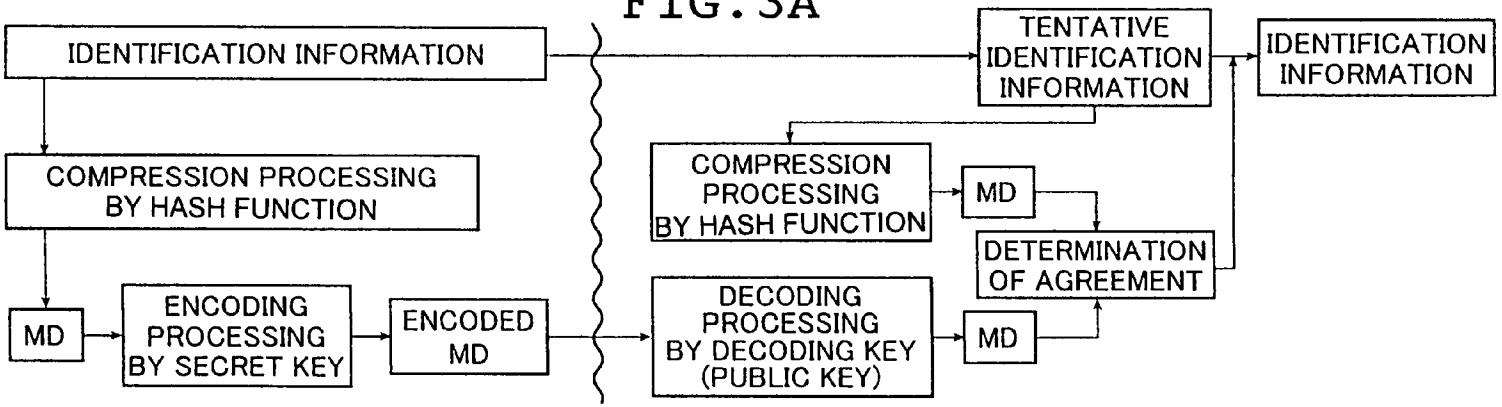
FIGS. 3A and 3B are schematic views, each explaining another example of the flow of operations in the present invention.

FIG. 3A shows an example of the flow of this operation.

In this mode, the encoding section 20 compresses the identification information acquired by the information acquiring section 18 by the hash function and arranges it as a message digest (hereinafter referred to as MD), encodes this MD by a secret key and sends the thus encoded MD to the information recording section 34 as encoded information (encoded MD), as shown in FIG. 3A. Further, as described above, the identification information is also sent from the information acquiring section 18 to the information recording section 34 which records both of the thus encoded MD and the identification information in the semiconductor memory 16.

Note that, as hash functions, various types of known methods such as MD-5, SHA-1, RIPEMD-160 and the like having a one-way hash function, a collision-intractable hash function and the like may be utilized.

On the other hand, when the ink tank 10 is mounted on the ink tank mounting section 32*a* of the printer 32, the information reading section 24 of the printer 32 reads the encoded MD and the identification information recorded in the semiconductor memory 16.

Next, as shown in FIG. 3A, the decoding section 26 decodes (decrypts) the encoded MD by the decoding key or the public key to produce a decoded MD as well as the information confirming section 38 compresses the identification information (tentative identification information) supplied from the information reading section 24 by the hash function to produce the MD, The information confirming section 38 confirms whether or not both the MDs are in agreement with each other. When both the MDs are appropriately in agreement with each other, the information confirming section 38 determines that the identification information is appropriate. When they are not in agreement with each other, the information confirming section 38 determines that the identification information is inappropriate and then executes processing similarly to that of the above example.

Figure 3B:
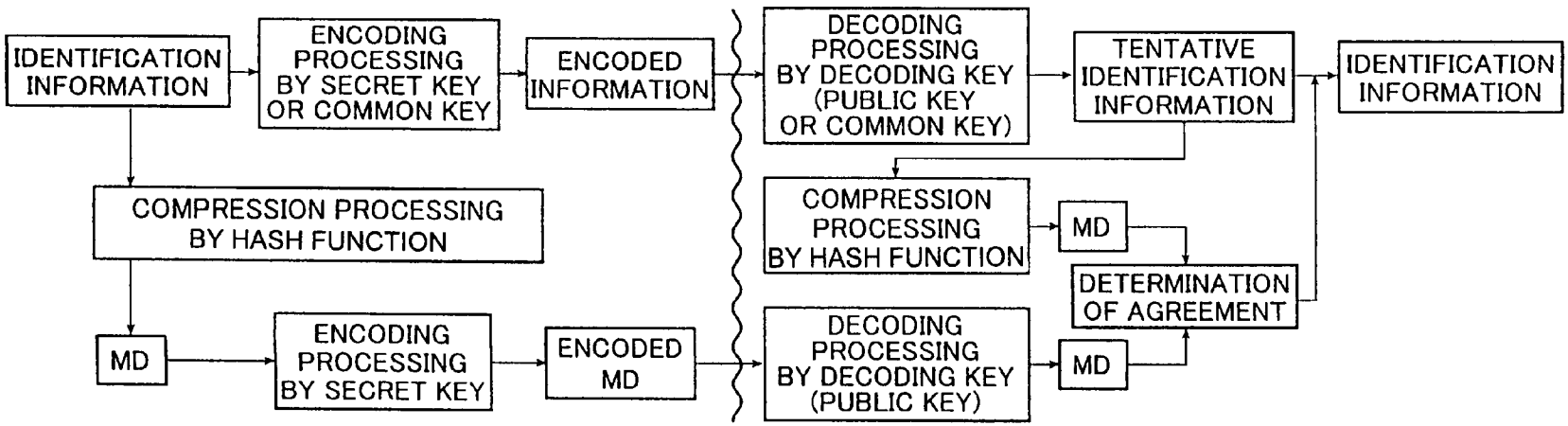

In the present invention, both the encoded information, which is obtained by encoding the identification information by a secret key or a common key which performs encoding and decoding by a same key, and the encoded MD, which is obtained by encoding the MD by a secret key, may further be recorded in the semiconductor memory 16. This mode will be described with reference to FIG. 3B.

According to this mode, in a process for manufacturing an ink tank, the identification information is arranged as the encoded information encoded by the secret key or the common key as well as the identification information is compressed with the hash function and arranged as the MD, the encoded MD is obtained by encoding the MD by the secret key, and both of them (the encoded information and the encoded MD) are recorded in the semiconductor memory 16 of the ink tank 10.

Note that when both the identification information and the MD are encoded by respective secret keys, both the secret keys may be the same keys or different keys. When the identification information is encoded by the common key cryptosystem, there is an advantage that load for decoding is light whereupon a period of time required for decoding by a printer or a computer connected thereto is short. On the other hand, when the identification information is encoded by the secret key, load for decoding is heavy whereupon, although this heavy load is imposed on the printer or the computer connected thereto, there is an advantage that the reliability of information can be more improved.

The printer on which the ink tank 10 is mounted decodes the encoded information by the decoding key, namely, the public key or the common key to obtain the (tentative) identification information and further arranges the identification information as the MD by compressing it with the hash function. On the other hand, the encoded MD is decoded to the MD by a decoding key.

Next, it is confirmed whether or not both the MDs are in agreement with each other. When both the MDs are in appropriate agreement with each other, it is determined that identification information is appropriate. Otherwise, the identification information is determined inappropriate, and then subjected to subsequent processing similarly to that of the above example.

In the above-described embodiments, the inkjet printer using the ink and the ink tank 10 as the supplies, that is to say, the ink as the consumable goods and the ink tank which accommodates ink and has a recording section in which the encoded information is recorded on the ink tank itself (case or container) as the consumables accommodation body has been explained as a representative example of the image recording apparatus; however, the present invention is not limited to the above example but, as described above, is applicable to the image recording apparatus employing, for example, various types of recording methods and recording materials. On this occasion, materials which executes various recording methods to be used in the image recording apparatus, various recording materials or other materials may be defined as the supply such as the consumable goods or the consumables accommodation body. Namely, the present invention is applicable to at least one of the supply such as the consumable goods and the consumables accommodation body to be used in the printer which adopts various types of non-silver halide photographing methods, such as a serial print method exemplified by an ink ribbon method, a transfer method exemplified by a thermal transfer method, an electrophotographic method, a sublimation method and the like, a photographing apparatus, the printer, which adopts various types of silver halide photographic methods, such as a printer for a photographing device, photoprinter for a print-output and the like.

Further, in the present invention, when the supply, for example, the consumables accommodation body has accommodated the consumable goods is mounted on the image recording apparatus, the supply such as the consumable goods and the consumables accommodation body are determined by a determination unit having the information reading section, decoding section and information confirming section provided in the image recording apparatus; however, the present invention is not limited to this type of determination unit and determination may be executed by an independent unit (constituted by the information reading section, the decoding section and the information confirming section) separated from the image recording apparatus.

Further, the above-described example has been arranged to target the consumable goods themselves and the consumables accommodation body which accommodates (or has accommodated) the consumable goods; however, the present invention is not limited to the above example and may target the consumbales accommodation case itself (which has not accommodated the consumable goods) for accommodate the consumable goods or may target a packaging material or a packaging case or container for packaging the consumable goods or an accommodating case or container for accommodating the consumable goods, before the consumables accommodation body is mounted on the image recording apparatus or the consumable goods is transferred to the consumables accommodation body which is to be mounted on the image recording apparatus and, further, may designate the consumables accommodation body itself which has accommodated the consumable goods as the commsumables goods.

While the supply, for the image recording apparatus of the present invention, the method of determining the supply for the image recording apparatus, and the method of manufacturing the supply for the image recording apparatus have been described above in detail with reference to various types of embodiments, the present invention is by no means limited to the aforementioned embodiments and it goes without saying that various improvements and modifications can be made within the range which does not depart from the gist of the present invention. Further, the cryptosystem has been described focusing on the public key criptosystem but the present invention is not particularly limited to this system and may instead apply the common key cryptosystem which uses the same keys at the times of encoding and decoding.

As described above in detail, according to the present invention, it can be advantageously prevented that the inappropriate supply such as the inappropriate consumable goods and consumables accommodation body are mounted on the image recording apparatus by mistake or misused therein in a case in which the ink tank the validity of which has expired or which is not suitable for the inkjet printer is mounted on the inkjet printer by mistake or an ink tank which does not correspond to the inkjet printer is used therein or in other similar cases. As a result, the deterioration of image quality and troubles caused by mounting an inappropriate supply by mistake or by misusing it can be eliminated so as to ensure that the image recording apparatus such as a printer, a photographing apparatus or the like exhibits predetermined performance in a stable manner.

What is claimed is:

1. A supply which is mounted on an image recording apparatus, comprising:

a recording section in which encoded identification information created by cryptographically encoding identification information related to said supply is recorded with said identification information such that said identification information and said encoded identification information can be read from said supply and compared to determine agreement, wherein said supply is any one of consumable goods, a consumables accommodation case for accommodating said consumable goods and a consumables accommodation body which has accommodated said consumable goods in said consumables accommodation case.

2. The supply according to claim 1, wherein said recording section is provided to at least one of said consumable goods in the consumables accommodation body and said consumables accommodation case of said consumables accommodation body.

3. The supply according to claim 1, wherein said encoded information is created by encoding by means of a public key cryptosystem.

4. The supply according to claim 1, wherein said identification information comprises at least one information selected from the group consisting of: information of manufacturing date, a lot number, a serial number, a term of validity for use, a term for validity of initial mounting, a content, a manufacturer, a type of a corresponding image recording apparatus, a type of supply, an accommodation amount of the supply and a size of the supply.

5. The supply according to claim 1, wherein the identification information corresponding to said encoded information is recorded as compressed information together with said encoded information.

6. The supply according to claim 5, wherein an operation of said identification information being compressed is executed using a hash function.

7. The supply according to claim 1, wherein said encoded information is encoded after said identification information is compressed.

8. The supply according to claim 1, wherein compressed encoded information that is obtained by encoding said identification information after it is compressed is also recorded, in addition to said encoded information.

9. The supply according to claim 1 wherein said recording section is of a magnetic, optical or magneto-optical type such that said encoded information or said identification information cannot be rewritten or copied.

10. A method of determining a supply which is mounted on an image recording apparatus, comprising the steps of:

decoding encoded identification information of said supply and decoding identification information of said supply cryptographically encoded after it is compressed by a decoding key which said image recording apparatus or a computer connected thereto has;

determining agreement between said encoded identification information and said identification information cryptographically encoded after it is compressed using the thus decoded information; and determining whether or not said supply is appropriate using a result of determination of said step of determining agreement.

11. The method of determining the supply according to claim 10, wherein said encoded identification information is encoded by a key different from said decoding key and wherein said identification information encoded after it is compressed is what is encoded by the key different from said decoding key after it is compressed.

12. The method of determining the supply according to claim 10, wherein it is determined that the supply is inappropriate, at least one of issuing a warning and switching a state in which said supply is usable to the other state in which said supply is unusable is executed.

13. The method of determining the supply according to claim 10, wherein said supply is any one of consumable goods, a consumable accommodation case for accommodating said consumable goods and a consumables accommodation body which has accommodated said consumable goods in said consumable case.

14. The method of determining the supply according to claim 13, wherein said recording section is provided to at least one of said consumable goods in the consumables accommodation body and said accommodation case of said consumables accommodation body.

15. The method of determining the supply according to claim 10, including the further steps of:

reading said encoded identification information and said identification information encoded after it is compressed;

compressing decoded identification information created by decoding said encoded identification information by said decoding key to obtain first compressed information;

decoding said identification information encoded after it is compressed by said decoding key to obtain second compressed information; and comparing said first compressed information with said second compressed information to determine whether or not said supply is appropriate.

16. A method of manufacturing a supply which is mounted on an image recording apparatus, comprising the step of:

recording identification information of said supply, and compressed encoded identification information of said supply created by compressing the identification information to obtain compressed identification information and cryptographically encoding the compressed identification information; and recording said identification information whereby agreement between said encoded information and said identification information may be determined.

17. The method of manufacturing the supply according to claim 16, wherein said encoded information is what is created by encoding said identification information by a different key from a decoding key and wherein said compressed encoded information is what is created by encoding said identification information by the key different from said decoding key after it is compressed.

18. The method of manufacturing the supply according to claim 16, wherein said supply is any one of consumable goods, a consumables accommodation case for accommodating said consumable goods and a consumables accommodation body which has accommodated said consumable goods in said consumables accommodation case.

19. The method of manufacturing the supply according to claim 18, wherein said recording section is provided to at least one of said consumable goods in the consumables accommodation body and said consumables accommodation case of said consumables accommodation body.

20. A supply which is mounted on an image recording apparatus, comprising:

a recording section in which encoded identification information created by cryptographically encoding identification information related to said supply is recorded with said identification information such that said identification information and said encoded identification information can be read from said supply and compared to determine agreement, wherein said encoded information is encoded after said identification information is compressed.

21. The supply according to claim 20 wherein said recording section is of a magnetic, optical or magneto-optical type such that said encoded information or said identification information cannot be rewritten or copied.

22. A method of determining a supply which is mounted on an image recording apparatus comprising the steps of:

decoding encoded identification information of said supply and decoding identification information of said supply cryptographically encoded after it is compressed by a decoding key which said image recording apparatus or a computer connected thereto has; and determining whether or not said supply is appropriate using the thus decoded information;

wherein said step of decoding includes the steps of:

reading said encoded identification information and said identification information decoded after it is compressed;

compressing decoded identification information created by decoding said encoded identification information by said decoding key to obtain first compressed information;

decoding said identification information encoded after it is compressed by said decoding key to obtain second compressed information; and comparing said first compressed information with said second compressed information to determine whether or not said supply is appropriate.

23. A method for determining a supply which is mounted on an image recording apparatus, comprising the steps of:

reading identification information related to said supply and encoded information created by cryptographically encoding said identification information from said supply;

decoding said encoded information by a decoding key which said image recording apparatus or a computer connected thereto has so as to obtain decoded identification information;

confirming whether or not said identification information and said decoded identification information are in agreement with each other; and determining whether or not said supply is appropriate using said identification information, upon said identification information and said decoding information being in agreement with each other.

24. A method of determining a supply which is mounted on an image recording apparatus, comprising the steps of:

reading identification information related to said supply and compressed encoded information created by compressing the identification information to obtain compressed identification information and cryptographically encoding the compressed identification information;

compressing said identification information to obtain first compressed information;

decoding said compressed encoded information by a decoding key which said image recording apparatus or a computer connected thereto has so as to obtain second compressed information;

confirming whether or not said first compressed information and said second compressed information are in agreement with each other; and determining whether or not said supply is appropriate using said identification information, upon said first compressed information and said second compressed information being in agreement with each other.

* * * * *